United States Patent [19]

Kiesewetter et al.

[11] 4,425,981

[45] Jan. 17, 1984

[54] SOUND ABSORBING BUILDING COMPONENT OF SYNTHETIC RESIN SHEETING

[75] Inventors: Norbert Kiesewetter; Bertalan Lakatos, both of Stuttgart, Fed. Rep. of Germany

[73] Assignee: Fraunhofer-Gesellschaft Zur Förderung der Angewandten Forschung e.V., Munich, Fed. Rep. of Germany

[21] Appl. No.: 322,275

[22] Filed: Nov. 17, 1981

Related U.S. Application Data

[63] Continuation-in-part of Ser. No. 85,378, Oct. 16, 1979, abandoned.

[30] Foreign Application Priority Data

May 23, 1979 [DE] Fed. Rep. of Germany ..... 2921050

[51] Int. Cl.[3] ..... E04B 1/82

[52] U.S. Cl. ..... 181/286; 181/288; 181/290; 181/292; 181/294; 52/144

[58] Field of Search ..... 181/210, 284–295; 52/144–145

[56] References Cited

U.S. PATENT DOCUMENTS

| | | | |
|---|---|---|---|
| 2,153,357 | 4/1939 | Wente | 52/144 X |
| 2,541,159 | 2/1951 | Geiger | 52/144 X |
| 2,671,522 | 3/1954 | Bourgeois | 181/293 |
| 2,710,335 | 6/1955 | Wong | 181/289 X |
| 3,035,657 | 5/1962 | Lemon | 181/290 |
| 4,149,612 | 4/1979 | Bschorr | 181/286 |
| 4,228,869 | 10/1980 | Bschorr | 181/286 |

FOREIGN PATENT DOCUMENTS

| | | | |
|---|---|---|---|
| 1094560 | 12/1954 | France | 181/287 |
| 1261426 | 4/1961 | France | 181/289 |

OTHER PUBLICATIONS

Bschorr et al., "Resonator Elements for the Attenuation and Absorption of Noises", pp. 111–114 (1982); with English Translation.

*Primary Examiner*—Benjamin R. Fuller

*Attorney, Agent, or Firm*—Birch, Stewart, Kolasch & Birch

[57] ABSTRACT

A sound-absorbing building component for indoor paneling consisting of at least two superimposed sheets, preferably made of a synthetic resin. At least one of the sheets is provided with cup-shaped indentations lying side-by-side in the manner of a grid, the bottom surfaces of these indentations being excitable to lossy vibrations upon the incidence of sound. The upper rims of the cup-shaped indentations are all covered by a further planar sheet which is likewise capable of vibrations. This further sheet seals off the air volumes contained in the individual cup-shaped indentations in an airtight fashion. Small lumpy or irregularly-sized bodies can be provided on the bottom surfaces of the cup-shaped indentations.

24 Claims, 14 Drawing Figures

650 Hz

NATURAL VIBRATION
(1.3) + (3.1)

1100Hz

NATURAL VIBRATION
(3.3)

FIG. 10A
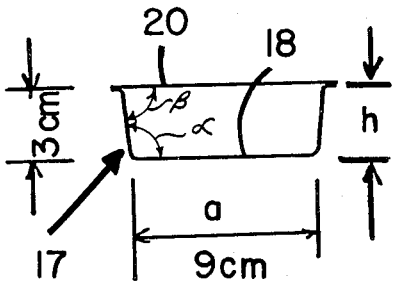
FIG. 10B
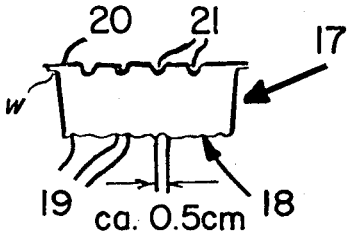
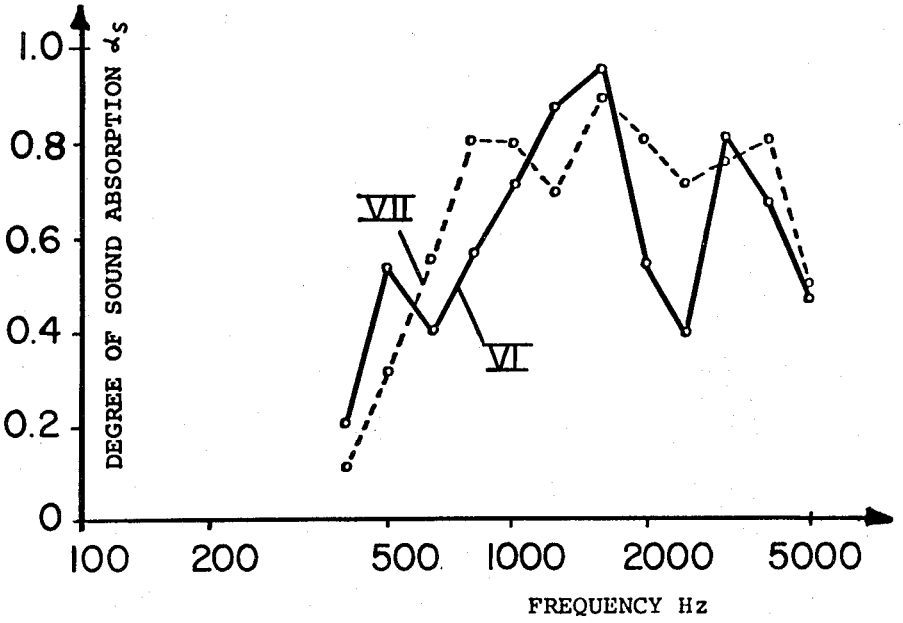
FIG. 11

SOUND ABSORBING BUILDING COMPONENT OF SYNTHETIC RESIN SHEETING

This application is a continuation-in-part of Ser. No. 085,378 which was filed on Oct. 16, 1979 now abandoned.

The invention relates to a sound absorbing building component for indoor paneling, this component consisting of at least two superimposed sheets, especially synthetic resin sheets.

In working areas, such as, for example, in large-scale offices, computer centers, workshops, and factory hangars, people are nowadays exposed to a constantly increasing noise pollution. Therefore, there is the task of maximally reducing the noise level to create acceptable working conditions. A lowering of the noise level can be attained by lining the rooms with sound-absorbing wall or coiling elements which are also called sound absorbers.

As can be seen, for example, from the book "Bauphysikalische Entwurfslehre" (Physical Construction Design Manual) by W. Fasold and E. Sonntag, vol. 4, chapter 3.4, Koeln-Braunsfeld, 1971, the sound abosrbers utilized heretofore consist generally of mineral fiber boards, the porosity of which can in some cases be disadvantageous in practical usage, for the porous sound absorbers are not washable, so that dirt and dust can very easily adhere to the surfaces thereof. For this reason, these sound absorbers are not suitable for interiors which must meet high hygienic demands, for example in hospitals, especially operating rooms, and in institution-size kitchens. These sound absorbers are likewise unsuitable for moist rooms, such as, for instance, breweries, dairies, etc., because the porous absorber will be fully saturated with moisture and will become ineffective. In rooms with skylight elements, the conventional, porous sound absorbers for suspended ceilings can only be used in honeycomb forms occupying a relatively large amount of space and having a high weight per unit area.

The invention is based on the problem of providing an effective sound absorber which, on the one hand, has a low weight, and, on the other hand, has a dense, uninterrupted surface and therefore can be readily kept clean and is hygienic. The sound absorber moreover is to be light-permeable, if desired, or is to be producible also in colors.

These objectives have been attained according to this invention in connection with the sound-absorbing building components discussed hereinabove by providing at least one sheet with cup-shaped indentations lying side-by-side in the manner of a grid, wherein the bottom surfaces to be exposed to the sound field during installation can be excited, upon the incidence of sound, to lossy vibrations, the upper rims of the cup-shaped indentations being all covered by a further, but planar sheet which is likewise capable of vibrating, this further sheet sealing off airtight the air volumes contained in the individual, cup-shaped indentations.

The bottom surfaces of the cup-shaped indentations, excited to vibrations upon the incidence of sound, thus absorb by interior friction a portion of the impinging sound energy. The sound absorption is especially high at the panel or plate resonances of the bottom surfaces. These panel resonances are determined by the dimensions and mechanical characteristics of the bottom surface of the cup-shaped identations, as well as by the resonant frequency of the mass-resiliency system consisting of the mass of the bottom surface and the air cushion enclosed in each cup-shaped indentation.

The resonant frequencies of the bottom surfaces of the cup-shaped indentations can be adjusted by selecting the parameters of shape and size of the bottom surface, the depth of the cup, the mass of the sheet or film based on the surface area, the mechanical loss factor, and the modulus of elasticity of the sheet.

To obtain a broad-band absorption, i.e., an enlargement in the number of resonances, it is possible according to a further embodiment of the invention to fashion, in one and the same building component, individual cup-shaped indentations different from one another, or to make the cup-shaped indentations of individual groups of such cup-shaped indentations different from one another; in particular, the bottom surface and/or the depth of the individual, cup-shaped indentations, or of the cup-shaped indentations of individual groups, can be of a different dimension.

Thus, the bottom surfaces can assume, for example, the shape of rectangles, circles, triangles, hexagons, etc.

In accordance with another embodiment of the invention, a broad-band absorption can also be attained by nestling into each other, or by arranging in series, at least two sheets with identically disposed, cup-shaped indentations in the direction of sound incidence, so that these sheets constitute, together with the planar sheet sealing off the cup-shaped indentations, a multiple-layer structure with sealed air cushions of varying thicknesses. In this connection, without the use of additional fastening means, the spacing of the sheets with the cup-shaped indentations can be determined by the angle of the conical cup walls, and the sheets with the cup-shaped indentations can be firmly joined to one another and to the planar sheet, for example, by welding.

A further embodiment of the invention can reside in that a broad-band absorption is evoked by embossings in the bottom surface of the cup-shape indentations. The dimensions of these embossings are substantially smaller than those of the cup shape. The individual embossings can have varying sizes and can be distributed regularly or irregularly on the bottom surface of the cup-shaped indentations.

The sheet with the cup-shaped indentations lying side-by-side in the manner of a grid consists preferably of a single thermoplastically deformed deep-drawn sheet and can selectively be clear or colored. Also, the planar sheet sealing off the cup-shaped indentations can be clear or colored. The sound-absorbing sheet element can have a turned-up edge according to a further feature of the invention, for attachment in a supporting construction.

The above-mentioned, sound-absorbing building element according to the invention is a sound absorber very highly suited for practical application, on the one hand, because it has a low weight and a dense, uninterrupted surface and thus can be easily kept clean and is also hygienic and moreover does not become ineffective in moist rooms by moisture saturation, and, on the other hand, this sound absorber shows a high sound absorption, because the bottom surfaces of the cup-shaped indentations facing the incident sound absorb the latter extensively due to the fact that they are excited to vibrations by the incident sound and absorb a substantial portion of the incident sound energy by internal friction, wherein the sound absorption in the resonance ranges is especially high. Besides the bottom surfaces of these cup-shaped indentations, the lateral surfaces are likewise excited to natural vibrations and, moreover, the cup shape of the indentations as a whole is likewise excited to natural vibrations which, in turn, are superimposed on the panel vibrations of the bottom and lateral surfaces of these cup-shaped indentations. All of the occurring forms of vibrations, due to the material damping or attenuation of the synthetic resin sheet or film, of which the cup-shaped indentations are made, contribute toward absorption of the sound energy.

Since, as mentioned above, the sound absorption is especially high in the region of the resonant frequencies of the natural vibrations to which the bottom surfaces, the lateral surfaces, and the entire cup shape of the indentations are excited, but is not as good outside of the region of the resonant frequencies, it is desirable to attain in the frequency range primarily under consideration, namely of about 100 to about 5000 Hz, a maximally uniform sound absorption, i.e., a degree of sound absorption extensively independent of the frequency, in order to be able to reduce with maximum uniformity the entire noise level in interior rooms.

It has been suggested above, in order to obtain a broad-band sound absorption by enlarging the number of resonances in one and the same sound-absorbing building element, to fashion the bottom surface and/or the depth of individual, cup-shaped indentations to be different from one another. Furthermore, a broad-band sound absorption can be effected by embossings in the bottom surfaces of the cup-shaped indentations, as mentioned hereinabove.

The present invention has as its objective, in particular, to still further improve the broad-band characteristic, i.e., the uniformity of the sound absorption over the sonar frequency range in question. Specifically, the sound absorption properties of the building element of this invention are to approach even more closely those of an ideal sound absorber.

For this purpose, according to a further development of the present invention, the provision is made in the sound-absorbing building element, in order to broaden the frequency range of the sound absorption and to increase the sound absorption degree of the sound-absorbing building element, to construct the surface contours and/or the surface structures and/or the surface weights of the bottom surfaces, based on the unit area, of different cup-shaped indentations of the sound-absorbing building element so as to be different from one another and/or to provide that the surface weight of the bottom surfaces of the cup-shaped indentations, based on the unit area, is different from the surface weight of the remaining material, based on the unit area, of the sheet exhibiting the cup-shaped indentations.

In this way, the number of resonant frequencies of the bottoms, of the sidewalls, and of the cup-shaped indentations in total can be substantially increased and thereby a considerably better characteristic of the degree of sound absorption can be attained as plotted over the sound frequency.

In particular, the sound-absorbing building element can be constructed such that the cup-shaped indentations of the same sound-absorbing building element consist of two or more groups of indentations, each of which has an elongated surface contour of the bottom surface, wherein the individual groups of indentations differ from one another in that the ratio of length or maximum length to width or maximum width of the bottom surfaces is made to be different.

In this connection, the surface contours of the bottom surfaces can be, in detail, rectangles, ellipses, or rhomboids (elongated rhombi); these configurations are, of course, merely especially preferred embodiments of elongated surface contours, since, in principle, other forms of elongated surface contours are likewise suitable.

The substantial advantage of these elongated surface contours resides in that they can be excited to considerably more natural vibrations than "compact" surface contours and thus the sound absorption is distributed more uniformly over the acoustic frequency range in question. Within the scope of the present invention, "elongated" surface contours are understood to mean those surface contours wherein the longitudinal dimensions are markedly or substantially larger than the width dimensions or, expressed more generally, contours which have, in at least one direction, a markedly or substantially larger extension than in another direction, especially in the direction extending perpendicularly thereto. In contrast, "compact" area contours are understood to mean those wherein the longitudinal dimensions are approximately equal to the width dimensions or, more generally expressed, contours having in all directions of their areas the same extension or substantially the same extension. Examples of such "compact" surface contours are circles, squares, regular polygons, or the like.

The reason why the compact surface contours are not so suitable resides in that, in case of panels with such compact surface contours a number of natural vibrations occurs at the same or almost the same frequency, whereas in the case of panels with elongated surface contours the corresponding natural vibrations are different from one another, namely in such a way that they vary markedly from one another. These relationships will be explained in greater detail below in connection with the description of the figures, regarding the differences occurring in the natural vibrations of a square panel and a rectangular panel.

It is especially preferred to construct a sound-absorbing building element of the last-discussed type in such a way that the length or maximum length of the elongated surface contours is the same in all groups of cup-shaped indentations, whereas the width or maximum width differs from one group to the next; or vice versa. In this way, since one of the two aforementioned dimensions of the cup-shaped indentations is the same, these different cup-shaped indentations can be more easily joined together without leaving additional interspaces above and beyond the required, narrow interstices, which would diminish the effect of the sound-absorbing building component.

An especially preferred embodiment is distinguished in that two groups of cup-shaped indentations are provided, wherein the ratio of length or maximum length to width or maximum width of the bottom surfaces in one group is about 1.2:1 to about 2:1, whereas this ratio is about 2.2:1 to about 4:1 in the other group. If three groups of cup-shaped indentations are provided, then it is preferred that the ratio of length or maximum length to width or maximum width in the first group is about 1.2:1 to about 2:1; in the second group about 2.2:1 to about 3:1; and in the third group about 3.2:1 to about 5:1. In this way, a satisfactory distribution of the individual resonant frequencies is attained over the entire acoustic frequency range of interest.

In another embodiment of a sound-absorbing building element according to the invention, the sheet material of the bottom surfaces of the cup-shaped indentations is thinner than the sheet material of the sidewalls of the indentations and of the webs between the individual indentations or between the sidewalls of neighboring indentations. In this way, a small weight per unit area is obtained for the bottom surfaces of the cup-shaped indentations, while at the same time the sidewalls of the cup-shaped indentations and the webs between the cup-shaped indentations are still sufficiently firm so that they impart an adequately high stability to the entire building element. Simulatneously the absorption curve in the panel resonances of the bottom surfaces becomes very broad and high, because the bottom surfaces, due to the projecting configuration, have a high loss factor and a small mass based on the surface area.

To broaden the absorption curve toward the lower frequencies, i.e., to greatly elevate the degree of sound absorption in the range of the low frequencies, the sound-absorbing building element can be constructed so that lumpy bodies are attached to the bottom surfaces of the cup-shaped indentations, wherein the size of the cross-sectional area of each of the lumpy bodies is small as compared to the size of the bottom surface of the respective indentation. These lumps can be synthetic resin particles, especially plastic beads applied to the bottom surfaces of the cup-shaped indentations so that they adhere thereto, especially by melting. Such a melting step can be effected very simply technically so that in spite of the application of the synthetic resin particles the sound-absorbing building element of this invention can be manufactured in an economical fashion.

If a greater "detuning" of the resonant frequencies toward lower frequency values is desired, then lumpy bodies will be employed consisting of a material, the specific gravity of which is large as compared with the specific gravity of the sheet material of the cup-shaped indentations. Such lumpy bodies are preferably metal particles, glass particles, as well as mineral or slag particles, especially particles having rounded surfaces, i.e., preferably metal, glass, mineral, or slag beads or globules.

Also in these instances of using heavier materials for the lumpy bodies, the sound-absorbing building element of this invention can be manufactured very economically by snugly enclosing the lumpy bodies with the sheet material of the bottom surfaces of the cup-shaped indentations to such an extent that the lumpy bodies are retained by this sheet material. This firm bond of the lumpy bodies with the sheet can be attained in an especially simple way by placing the lumpy bodies in a deep-drawing (thermoforming) mold wherein the cup-shaped indentations are formed, so that the sheet, during deep-drawing, is placed around the lumpy bodies in the zone of the bottoms of the cup-shaped indentations and thus retains the bodies in place.

Preferably, the diameter or average diameter of the lumps is between about 1 mm. and about 8 mm., whereas the size of the bottom surfaces of the cup-shaped indentations ranges between about 10 $cm^2$ and about 100 $cm^2$. As was determined in investigations within the scope of the present invention, these dimensions result in especially favorable sound absorption properties.

Finally, another possibility for increasing the number of resonant frequencies and thus for attaining a broad-band absorption resides in providing that the cup-shaped indentations of the same sound-absorbing building element comprise two or more groups differing from one another in that the amount and/or size and/or distribution and/or weight and/or material of the lumpy bodies applied to the bottom surfaces is different so that the individual bottom surfaces are "detuned" with respect to one another in their resonant frequencies. By means of this measure, the resonant frequencies can be distributed in such a variegated fashion and so satisfactorily that a sound-absorbing building element is obtained having an almost ideal characteristic of the degree of sound absorption over the acoustic frequencies.

Still another possibility for detuning the individual bottom surfaces with respect to one another resides in providing that the cup-shaped indentations of the same sound-absorbing building element comprise two or more groups differing from one another in that the arrangement and/or size of embossings arranged in the bottom surface is varied. The diameter of the embossing can range between 1 mm. and 10 mm., preferably between 3 mm. and 7 mm., and their depth can range between 2 mm. and 5 mm., preferably between 3 mm. and 4 mm., while the size of the bottom surface of the cup-shaped indentations is respectively between about 10 $cm^2$ and 100 $cm^2$. In this commection, it is especially preferred to provide between about 0.5 and about 5, preferably between about 1 and about 2, embossings per square centimeter. The embossings can be irregular, or they can be in a statistical distribution, or they can be distributed according to a predetermined, regular pattern on the bottom surface. Since the additional production of embossings in the bottom surfaces of the cup-shaped indentations requires only an especially minor additional expenditure from a manufacturing viewpoint, this embodiment of the sound-absorbing building element according to the invention is to be preferred in all those cases where expenses for the sound-absorbing material are especially critical, though a broad-band absorption is of great importance.

In all cases where several groups of differing, cup-shaped indentations are provided, it is preferred that the cup-shaped indentations of each of the individual groups are distributed regularly or irregularly or statistically over the entire sound-absorbing building element so that, on the average, essentially the same sound absorption characteristics are obtained in each surface area region of the sound-absorbing building element comprising several cup-shaped indentations.

To rigidify the building element, the cover sheet located on the upper rims of the cup-shaped indentations can be provided with profiling, preferably with corrugations. Besides, the rear side of the cover sheet can be fashioned to be self-adhesive so that the present sound-absorbing building element can be mounted in a very simple and economical manner to ceilings and walls of indoor rooms.

The above-described advantages, as well as further advantages and features of the invention will be explained in greater detail below with reference to the figures of the drawings and using as examples several, especially preferred embodiments, wherein.

Figure 8:
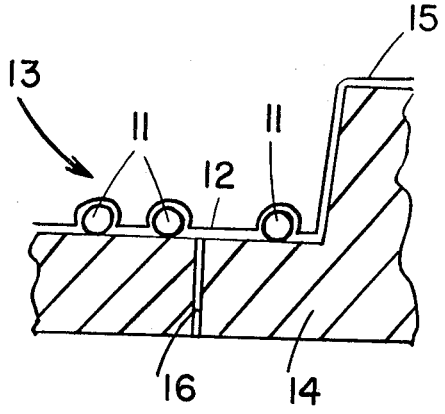
Figure 9:
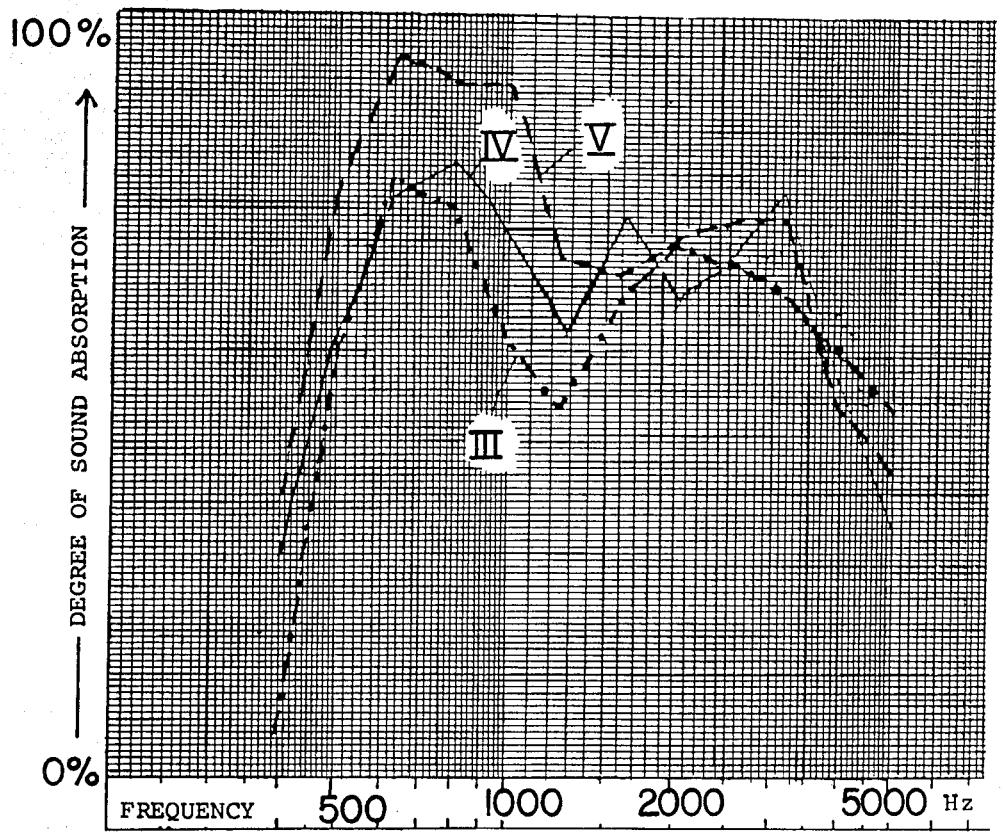
Figure 12A:
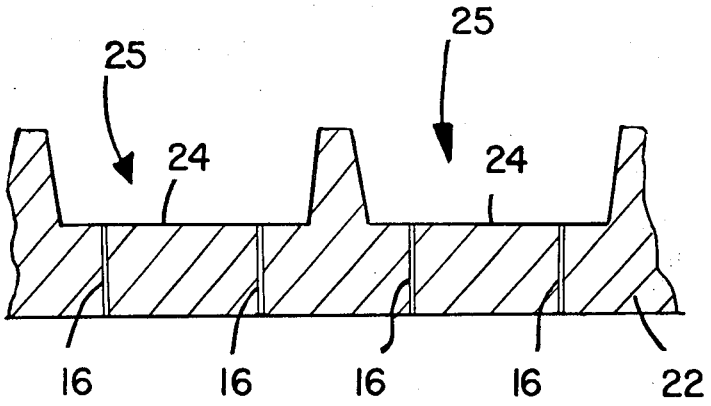
Figure 12B:
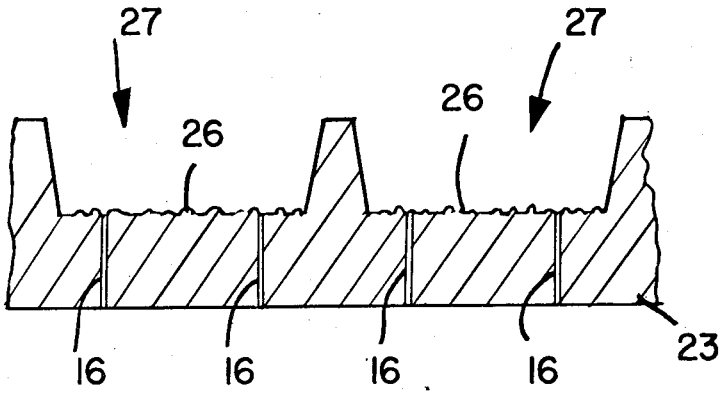

FIG. 8 is a view, partially in section, of a deep-drawing mold used to form cup-shaped indentations, lying side-by-side in a grid pattern in a sheet by means of the deep-drawing (thermoforming) method, wherein beads of a relatively heavy material are arranged on the bottom of the deep-drawing mold, the evolving bottom of the cup-shaped indentation being placed around these beads during deep-drawing so that the beads are snugly retained by this bottom;

FIG. 9 shows the degree of sound absorption of sound-absorbing building elements according to this invention wherein the bottoms of the indentations, in one instance, are not weighted with beads, in the next instance are weighted with glass beads, and in the third instance are weighted with lead beads;

FIG. 10 shows a section through a cup-shaped indentation and a planar sheet used to cover same, wherein the bottom is, in one instance, fashioned without embossings and, in the other instance, is provided with embossings;

FIG. 11 shows the degree of sound absorption of a building element of this invention wherein the bottoms of the indentations are smooth, as shown in FIG. 10*a*, and wherein these bottoms are provided with embossings, as illustrated in FIG. 10*b*; and FIG. 12 shows a deep-drawing mold for producing the sheet with the cup-shaped indentations, namely in FIG. 12*a* with a smooth bottom surface and in FIG. 12*b* with irregular embossings in the bottom surface.

Figure 1:
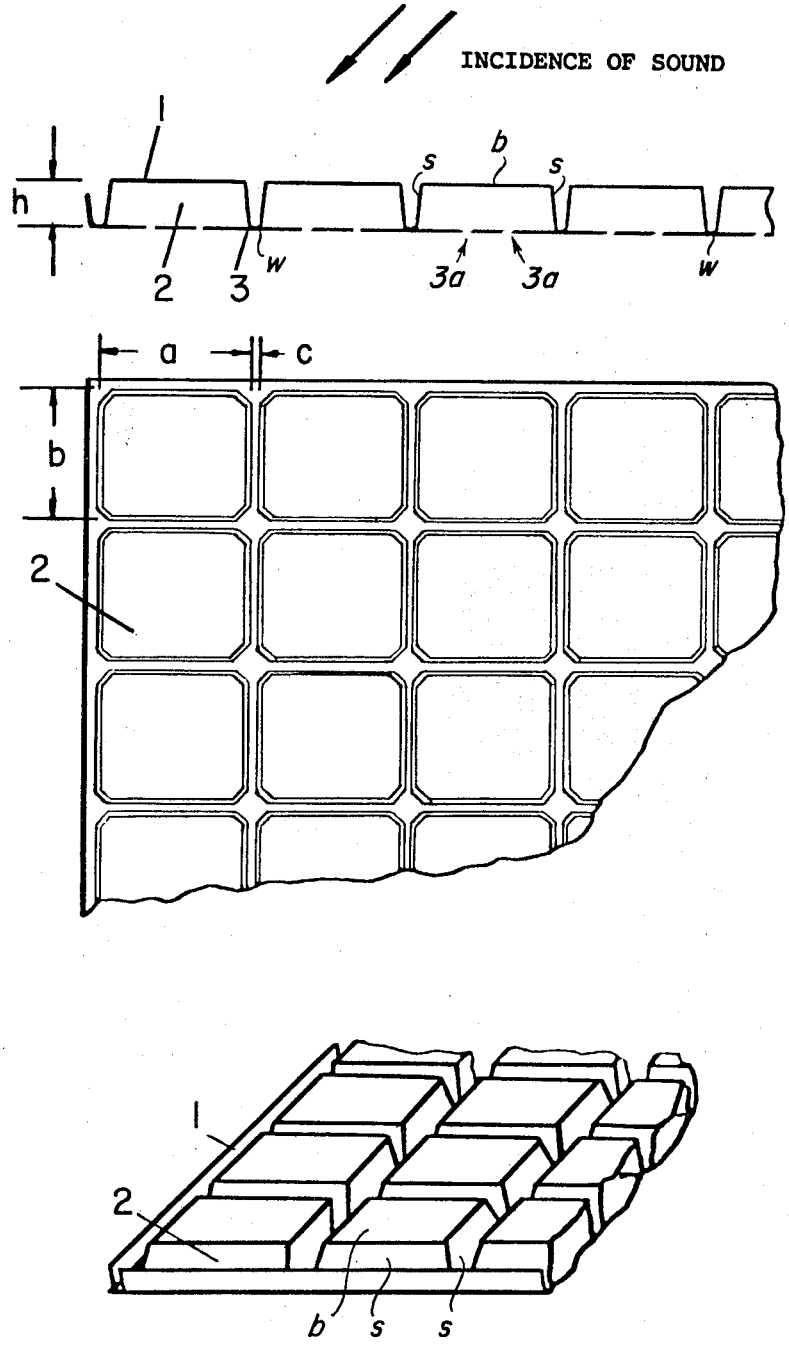
FIG. 1 shows a sound-absorbing building element consisting of a single sheet with cup-shaped indentations and a planar sheet, illustrated in a sectional view, a top view, and a perspective view.

The building element shown in FIG. 1 in a top view, in a sectional view, and in a perspective view consists of a synthetic resin sheet 1 with cup-shaped indentations 2 arranged side-by-side in a grid pattern and having a height of, for example, h=30 mm. The cup-shaped indentations 2 have a rectangular shape having the dimensions of, for example, a=90 mm. and b=80 mm. at the upper rim and a mutual spacing of, for example, c=7 mm. The sheet 1 consists of a synthetic resin, e.g., polyethylene, having a thickness of, for instance, 0.1 mm.

The cup-shaped indentations of the sheet 1 include a generally planar bottom wall b and a plurality of generally planar sidewalls s which are covered along their top edges by a planar sheet 3, consisting preferably of polystyrene having a thickness of, for example, about 0.3 mm., so that the air volume of each individual cup-shaped indentation 2 is separately sealed in an airtight fashion. A web section w connects adjacent cup-shaped indentations. Such a building element has a weight of, for example, 1 kg. with a surface area of, for example, 1 $m^2$.

The sheets can be clear or also colored.

Figure 2:
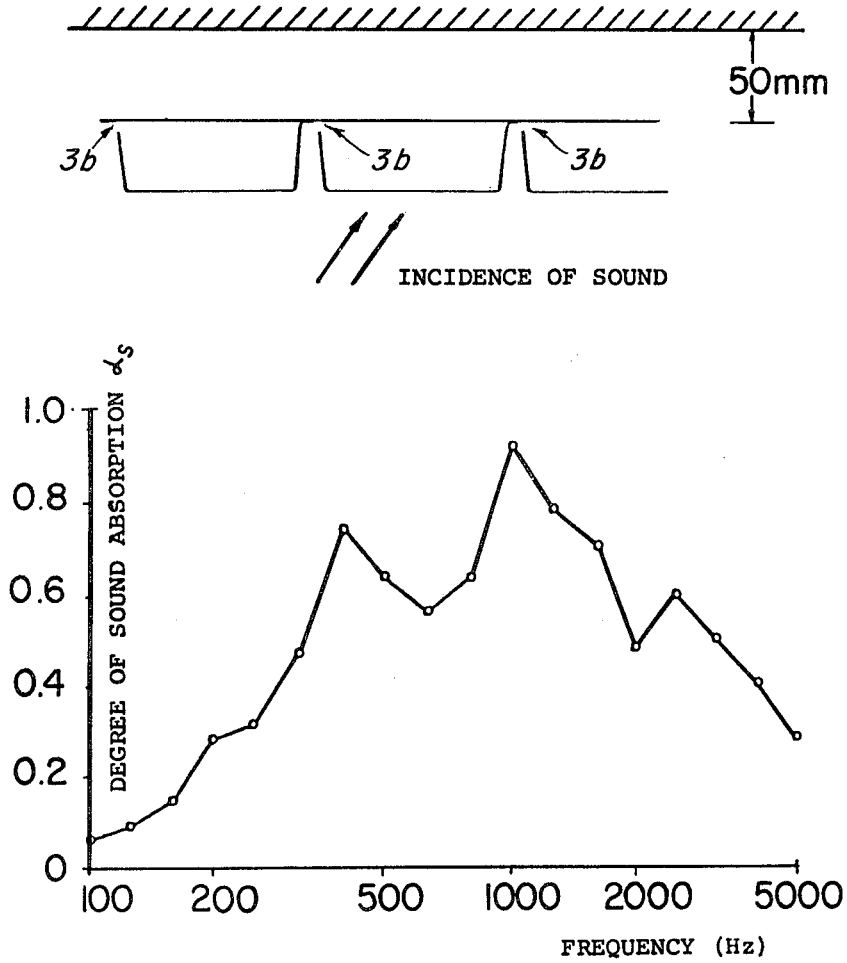
FIG. 2 shows an absorption curve for the building element of FIG. 1.

FIG. 2 shows the sound absorption degree of a building element according to FIG. 1 plotted in dependence on the acoustic frequency, measured at a distance of 50 mm. of the building element from a wall.

Figure 3:
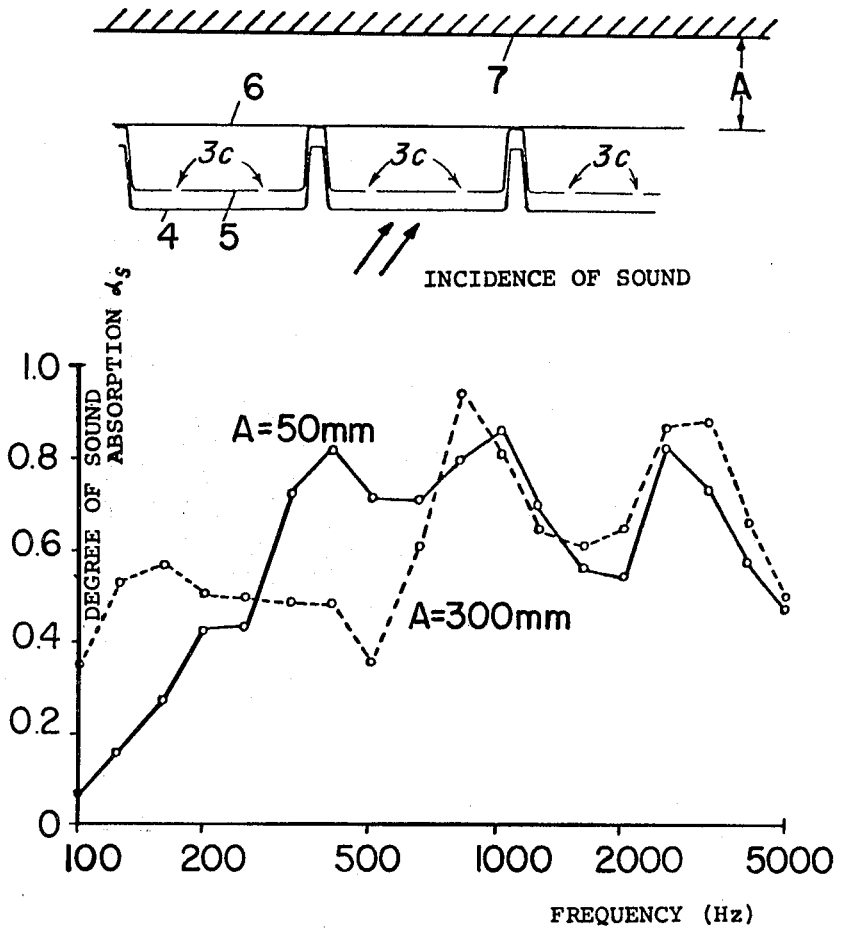
FIG. 3 shows an absorption curve for a sound-absorbing building element consisting of two sheets with cup-shaped indentations and a planar sheet, and a sectional view of such a building component.

FIG. 3 shows a building element wherein two sheets 4 and 5, arranged in series with their cup-shaped indentations in the direction of sound incidence, are joined to a planar sheet 6. The degree of sound absorption attainable with such a building element at a varying distance A from a wall 7 can be seen from the curves.

Figure 4:
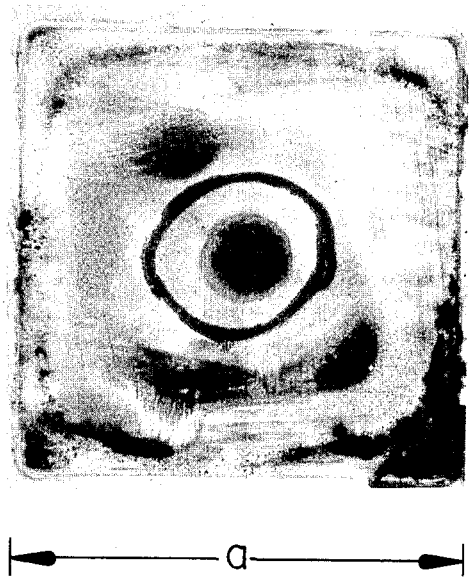
FIG. 4 shows Chladni sonorous figures of a square bottom surface of a cup-shaped indentation, illustrating the natural vibrations of this bottom surface at two different frequencies.
Figure 4:
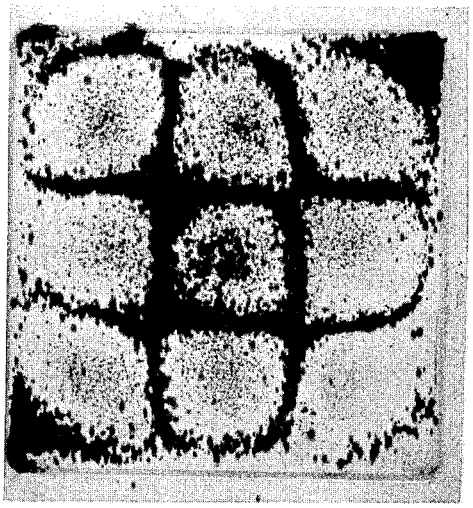

Reference is now had to FIG. 4 showing that the number of natural frequencies of a square panel is relatively limited. These natural vibrations can be expressed by the equation:

$$A = A_{m,n} \cdot \sin(\pi/a) \cdot n \cdot x \cdot \sin(\pi/a) \cdot m \cdot y \quad (1)$$

wherein the individual symbols in the equation mean the following:

$A_{m,n}$ = amplitude of the natural vibration

A = deflection of the panel a = lateral length of the square panel x, y = coordinates of the panel wherein one corner of the panel is in the zero point of the coordinate system whereas the adjoining sides extend along the x-axis and y-axis, respectively m, n = integers larger than or equal to 1.

For reasons of symmetry, the natural vibrations (m, n) and (n, m) occur at the same frequency in case of square panels. FIG. 4 shows as an example a heterodyning or superposition of the panel vibrations (1, 3) and (3, 1) at 650 Hz and the natural vibrations (3, 3) at 1100 Hz, wherein the lateral length a of the square panel is 6.7 cm. in these cases.

In contrast thereto, the natural vibrations of rectangular panels can be expressed by the equation:

$$A = A_{m,n} \cdot \sin(\pi/a) \cdot n \cdot x \cdot \sin(\pi/b) \cdot m \cdot y \quad (2)$$

wherein a is the length and b is the width of the rectangular panel, while the remaining symbols have the same meanings as in the equation indicated hereinabove.

In the case of rectangular panels, as contrasted to square panels, the natural vibrations (m, n) and (n, m) are at different frequencies, so that, in total, substantially more natural vibrations result in rectangular panels, meaning an over-all improvement of the sound absorption, since the sound absorption has a maximum at the resonant frequencies. Consequently, it is advantageous to make the bottom surfaces of the cup-shaped indentations in the sound-absorbing building elements rectangular, and furthermore, to provide two or more groups of differently large rectangular bottom surfaces, namely in particular with varying ratios of length a to width b.

Figure 5:
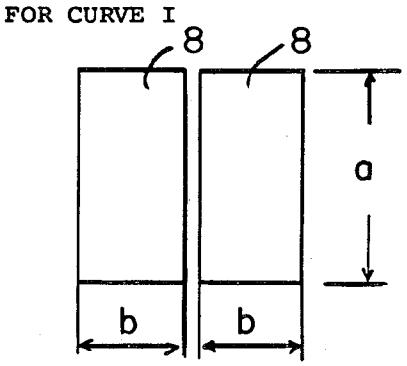
FIG. 5 shows two rectangular bottom surfaces of equal size pertaining to two adjacent cup-shaped indentations.
Figure 6:
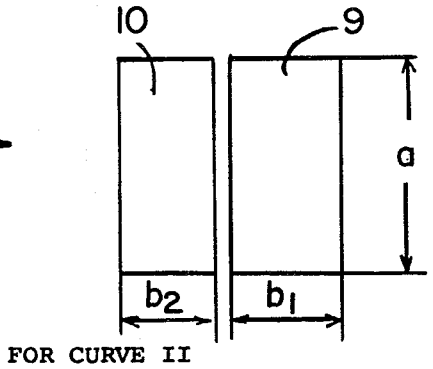
FIG. 6 shows two different-sized bottom surfaces of two adjacent cup-shaped indentations.
Figure 7:
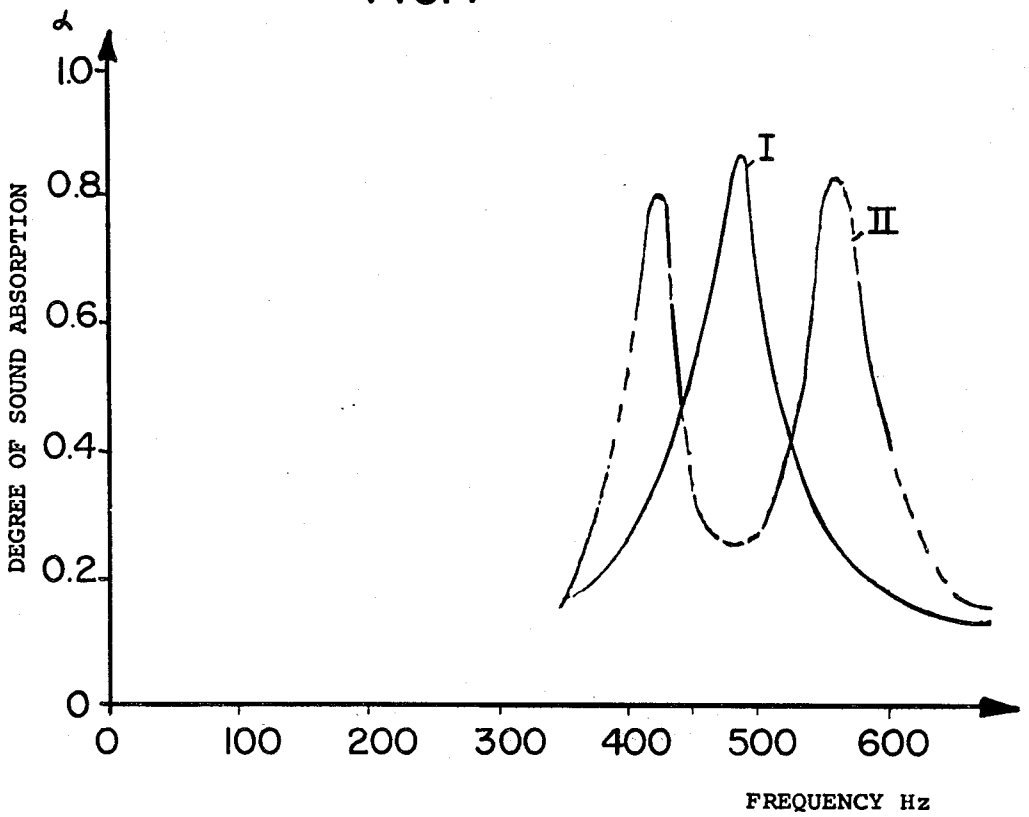
FIG. 7 shows the degree of sound absorption of the arrangement of FIG. 5 and of the arrangement of FIG. 6 in dependence on the acoustic frequency.

To illustrate the effects resulting with the use of differently large rectangles as the bottom surfaces of cup-shaped indentations, FIG. 7 shows two sound absorption curves I and II, curve I relating to the sound absorption of the arrangement according to FIG. 5 and curve II relating to the sound absorption of the arrangement of FIG. 6. The arrangement of FIG. 5 comprises two bottom surfaces 8 of polyvinyl chloride sheeting having a thickness of 0.3 mm., these surfaces being rectangles of equal size having a length of a=70 mm. and a width of b=32.5 mm. The arrangement according to FIG. 6 likewise comprises two bottom surfaces 9, 10, also made from polyvinyl chloride sheet having a thickness of 0.3 mm., but wherein one rectangular bottom surface 9 is larger than the other rectangular bottom surface 10. While the length a of the two bottom surfaces 2, 3 in this embodiment is in each case 70 mm., the bottom surface 9 exhibits a width of $b_1$=35 mm. and the bottom surface 10 has a width of $b_2$=30 mm.

As shown in FIG. 7, a broadened absorption curve results in the arrangement of FIG. 6, the degree of sound absorption of which is plotted over the frequency in the form of curve II, as compared to the arrangement of FIG. 5, the sound absorption curve I of which has only a single maximum.

The above remarks apply, of course, in principle also to other surface configurations so that the general statement can be made that elongated bottom surfaces are to be preferred over compact bottom surfaces, i.e., for example, ellipsoidal bottom surfaces are to be preferred over circular bottom surfaces, because the former have a larger number of natural frequencies than the latter.

The detuning, i.e., the changing of the natural frequencies of the individual bottom surfaces can also be effected by arranging, as indicated in FIG. 8, lumpy bodies 11, preferably beads, on the sheet-like bottom surfaces 12 of the cup-shaped indentations 13.

FIG. 8 shows a partial sectional view through a deep-drawing or thermoforming mold 14 wherein the cup-shaped indentations 13 lying side-by-side in a grid pattern, are formed with the aid of a synthetic resin sheet 15. One of the many vacuum ducts, terminating in the zones of the deep-drawing or vacuum-forming mold where the bottom surfaces 12 are produced during deep-drawing, is indicated at 16. An especially preferred process for the attaching of lumpy bodies 11, for example glass beads or lead beads, to the bottom surfaces 12 of the cup-shaped indentations 13 resides in arranging the lumpy bodies 11, prior to conducting the deep-drawing step, in the zones of the deep-drawing mold 14 where the bottom surfaces 12 of the cup-shaped indentations 13 are produced during deep-drawing. When the cup-shaped indentations 13 are being formed during deep-drawing, while the lumpy bodies 11 are arranged in the just-mentioned zones, then the synthetic resin sheet 15 snugly surrounds the lumpy bodies 11 due to the vacuum generated by the vacuum ducts 16, namely to such an extent that these lumpy bodies 11 are encompassed more than halfway by the synthetic resin sheet 15. Consequently, the lumpy bodies can no longer detach themselves from the bottom surfaces 12 after completion of the deep-drawing step and after cooling and/or solidification of the bottom surfaces 12, but rather are flushly retained thereby.

FIG. 9 illustrates the degree of sound absorption of various sound-absorbing building elements having cup-shaped indentations lying grid-like side-by-side, wherein the bottom surfaces of these indentations, to be exposed to the acoustic field during installation, can be excited to lossy vibrations, the upper rims of the cup-shaped indentations being covered in their entirety by a further sheet which is likewise capable of vibrating but has a planar configuration and seals, in an airtight fashion, the air volumes contained in the individual cup-shaped indentations. The curve III shown in dot-dash lines shows the curve for the degree of sound absorption in a building element wherein the bottom surface of the cup-shaped indentations are smooth and are not weighted with lumpy bodies; the bottom surfaces in this case are rectangular and have a length of 9 cm. and a width of 8 cm.

In contrast thereto, the curve IV shown in solid lines and the curve V shown in dashed lines show respectively the effect of weighting the bottom surfaces by lumpy bodies. Here again, the bottom surfaces each have a length of 9 cm. and a width of 8 cm., and are weighted in each case by, respectively, ten lumpy bodies. Curve IV shows the degree of sound absorption with a weighting of the bottom surfaces by glass beads having a diameter of 5 mm., and curve V shows the degree of sound absorption with a weighting of the bottom surfaces by lead beads having a diameter of 5 mm. As can be seen therefrom, the lumpy bodies result, in total, in an increase in the degree of sound absorption and in a broadening of the usable frequency range toward lower frequencies. As is clearly shown by curve V, the lead beads considerably improve, in particular, the absorption in a frequency range from 400 to 1200 Hz, i.e., the degree of sound absorption is greatly raised, and furthermore the degree of sound absorption even at the higher frequencies of 1200–3500 Hz is still above the degree of sound absorption of the building element wherein the bottom surfaces of the cup-shaped indentations are not weighted. Only above 3500 Hz does the degree of sound absorption according to curve V drop below that of curve III.

As can be seen from curve IV, the weighting by glass beads in the described embodiment does not result in a rise in the degree of sound absorption in the lower frequency range which is as pronounced as in the case of weighting the bottom surfaces with lead beads which, by the way, is also understandable in view of the lower weight of the glass beads. However, in total, an elevation of the degree of sound absorption is attained by the glass bead weighting practically in the entire frequency range in question of 400 to almost 5000 Hz, as well as a smoothing of the curve of the sound absorption degree over the frequency, i.e., the differences between the maxima and minima of curve IV are smaller than those of curve III, meaning a lesser dependency of the degree of sound absorption on the respective acoustic frequency.

Finally, as shown in FIGS. 10 and 11, another possibility for increasing the number of resonant frequencies and thus for attaining a broad-band absorption resides in providing the individual bottom surfaces of the cup-shaped indentations with embossings 19. In particular, the bottom surfaces 18 of individual cup-shaped indentations 17 can be detuned with respect to one another so that, thus, two or more groups of cup-shaped indentations 17 are produced, differing in that their bottom surfaces 18 are equipped with differently arranged or constructed embossings 19, as indicated by FIG. **10*b*. For comparison purposes, a cup-shaped indentation 17 with a smooth bottom surface 18 of the same size is illustrated in FIG. 10*a*; both cup-shaped indentations of FIGS. 10*a* and 10*b* are covered by a cover sheet 20**.

In FIG. 11, the degree of sound absorption of a building element with cup-shaped indentations 17, the bottom surfaces 18 of which are smooth, is indicated by curve VI shown in full lines, whereas curve VII illustrates the degree of sound absorption of a building element wherein the bottom surfaces 18 of the cup-shaped indentations 17 are provided with embossings 19. In detail, curves VI and VII are based on the following exemplary configurations of the cup-shaped indentations:

In both cases the bottom surfaces 18 of the cup-shaped indentations 17 are square, the lateral length a being 9 cm.; the height h, i.e., the distance between bottom surface 18 and cover sheet 20 is likewise 3 cm. in both cases. In the bottom surfaces 18 of the embodiment of FIG. 10*b*, respectively, 100 embossings are provided in an irregular distribution, the diameters of the embossings varying between 3 mm. and 7 mm. and the depths of the embossings varying between about 3 mm. and about 4 mm. The bottom surfaces 18 of different cup-shaped indentations 17 of one and the same building element differ from one another in that the arrangement of the embossings varies from one bottom surface to the next.

As can be seen from FIG. 11, due to this construction and arrangement of the embossings 19 in the bottom surfaces 18, a substantially more uniform curve of the degree of absorption is attained in the frequency range under consideration of about 500 to about 5000 Hz, compared with smooth bottom surfaces 18.

The cover sheet 20 can be provided with profiling 21, for example, corrugations, for rigidifying purposes, as shown in FIG. 10*b*. Besides, the rear side, i.e., the side of the cover sheet 20 facing away from the bottom surface 18, can be made self-adhesive to facilitate installation.

In FIGS. 12*a* and 12*b*, a deep-drawing mold is shown in a sectional view. By means of this mold, sheets can be provided by deep-drawing with cup-shaped indentations. By means of the deep-drawing mold 22 according to FIG. 12*a*, cup-shaped indentations of the type shown in FIG. 10*a* can be produced, with a smooth bottom 11, and by means of the deep-drawing mold 23 according to FIG. 12*b*, cup-shaped indentations of the type shown in FIG. 10*b* can be formed, which have embossings. For this purpose, the bottom 24 of the mold recesses 25 in the deep-drawing mold 22 is smooth, while the bottom 26 of the mold recesses 27 is provided with small protuberances and depressions. Vaccum ducts are indicated at 16.

In any of the various embodiments of the invention the pressure inside of the cup-shaped indentations 2,13 and 17, i.e. the pressure in the space enclosed by the synthetic resin sheets 1 and 3 in FIG. 1, or in the space enclosed by the synthetic resin sheets 4 and 5 as well as by the synthetic resin sheets 5 and 6 in FIG. 3, or in the space enclosed by the cover sheet 20 and the cup-shaped indentations 17 in FIGS. 10A and 10B is atmospheric pressure. Therefore it is neither necessary to evacuate such spaces to some degree nor to pressurize such spaces. Nevertheless it is preferred to sealingly close these spaces airtight, but it is also possible to provide a connection between such spaces and the outer atmosphere, e.g. by one or more fine openings 3*a* (FIG. 1) or by making a connection 3*b* (FIG. 2) between the cup-shaped indentation and the cover sheet as well as a connection 3*c* between two superimposed cup-shaped indentations (FIG. 3) not fully airtight, so that the aforesaid spaces are sealed nearly airtight, i.e. that there is no remarkable inflow and outflow of air into and out of such spaces during sound absorption.

The bottom surfaces 1,4,5 and 18 of the cup-shaped indentation are preferably planar, and in the event that there are provided embossings or dimples 19 or lumpy bodies 11, such embossings, dimples or lumpy bodies are arranged in the plane of the bottom surfaces of the cup-shaped indentations.

Preferred dimensional ranges of length a, width b, $b_1$ and $b_2$ and of the areas $a \times b$, $a \times b_1$ and $a \times b_2$ of the bottom surfaces are such that the length a is in the range from 1 cm to 15 cm, the widths b, $b_1$ and $b_2$ are in the range from 1 cm to 15 cm and at the same time the areas $a \times b$, $a \times b_1$ and $a \times b_2$ are in the range from 10 $cm^2$ to 225 $cm^2$. The height h is preferable in the range from 1 cm to 10 cm.

As to the angles $\alpha$ and $\beta$ enclosed between the side walls of the cup-shaped indentations and the bottom surface of the cup-shaped indentations and indicated in FIG. 10A are in any embodiment preferably such that $\alpha$ is in the range from 90°to 95° and $\beta$ in the range from 85° to 90°.

The preferred thickness of the synthetic resin sheets forming the cup-shaped indentations as well as the thickness of the planar sheets 3,6 and 20 is in the range from 0.05 to 1 mm.

In such embodiments of the invention in which the weight per unit area of the bottom surfaces of the cup-shaped indentations is different from the weight per unit area of the remaining material of the sheet having the cup-shaped indentations the configuration is preferably such that the material forming the bottom surfaces of the cup-shaped indentations is thinner than the material forming the side walls s of the cup-shaped indentations but has a uniform thickness whereas the thickness of the material forming the side walls s increases from adjacent the bottom surfaces to adjacent the planar sheet 3,6 or 20; the webs connecting adjacent cup-shaped indentations can have the same or even a greater thickness as the side walls s at their connections with the webs w (see FIGS. 1, 3, 10A and 10B); the thickness of the webs in these cases is preferably 1.5 to 3 times of the material forming the bottom surfaces.

The embossings or dimples 19 have preferably diameters in the range from 1 mm to 10 mm and depths in the range from 1 mm to 5 mm, with the thickness of the material in which the embossings or dimples are formed being uniform over the whole bottom surface even in the areas of the embossings or dimples which are preferably circular. The maximal depth of the embossings or dimples being preferably not more than 0.1 of the height h of the cup-shaped indentations.

As to the lumpy bodies 11 they have preferably a diameter in the range from 0.5 mm to 5 mm and they are statistically uniformly distributed over the whole bottom surface of the respective cup-shaped indentation.

By the present invention there is provided particularly a sound-absorbing building component for indoor paneling, comprising:

(a) a first sound-absorbing sheet, having a plurality of cup-shaped indentations lying side-by-side in a grid pattern each of said cup-shaped indentations including a generally planar bottom wall to be exposed to the acoustic field during installation, said bottom wall being excitable to a plurality of natural vibrations upon the incidence of sound at a plurality of frequencies and a plurality of generally planar sidewalls which are also excitable to natural vibrations; and (b) the upper rims of the cup-shaped indentations all being covered by a planar second sheet wich is likewise capable of vibrations sealing off in an airtight fashion the air volumes contained in the individual, cup-shaped indentations thereby broadening the frequency range of the sound absorption and increasing the degree of sound absorption of said building component.

The invention also provides a light weight sound-absorbing building component for indoor paneling, comprising:

(a) a first synthetic resin sheet having a plurality of cup-shaped indentations arranged in a grid pattern, each of said cup-shaped indentations including a generally planar bottom wall and a plurality of generally planar sidewalls, the bottom walls of said cup-shaped indentations having an area of between about 10 $cm^2$ and 100 $cm^2$, said bottom walls being excitable to a plurality of natural vibrations upon the incidence of sound having a frequency of about 100 to about 5000 Hz, said sidewalls also being excitable to natural vibrations; and (b) a second planar synthetic resin sheet which is also capable of vibrations, covering the upper rims of said cup-shaped indentations to form a plurality of air-tight air volumes corresponding to the individual cup-shaped indentations, wherein the bottom surfaces, the lateral surfaces and the cup-shaped indentations as a whole are excited to natural vibrations on the incidence of sound to contribute toward the absorbance of sound energy to obtain a degree of sound absorption extensively independent of the frequency in order to reduce with maximum uniformity the entire noise level in interior rooms.

The advantages attainable by the invention reside particularly in that the sound absorbing building elements have a smooth, uninterrupted surface offering only little adhesion possibility for dirt and thus are readily washable. Thereby, the accumulation of bacteria on the absorber surface is prevented. This is of importance, above all, in hospitals, especially operating rooms, and in business operations of the grocery industry. Also in institution-size kitchens, where the ample fat deposits would clog the pores of the conventional, porous absorbers, the smooth, washable surface of the sound-absorbing building elements of the present invention is of advantage. Besides, the building elements can be renewed from time to time, since they are readily exchangable and inexpensive.

Sound-absorbing building elements according to this invention do not absorb moisture and thus are also suitable for moist areas. In the clear design, the elements can be employed in rooms with skylight elements such as suspended ceilings. Also the low weight of the sound-absorbing building elements can be of advantage in some cases.

The invention being thus described, it will be obvious that the same way be varied in many ways. Such variations are not to be regarded as a departure from the spirit and scope of the invention, and all such modifications are intended to be included within the scope of the following claims.

What is claimed is:

1. A sound-absorbing building component for indoor paneling, comprising:

(a) a first sound-absorbing sheet, having a plurality of cup-shaped indentations lying side-by-side in a grid pattern, each of said cup-shaped indentations including (1) a planar bottom wall to be exposed to an acoustic field during installation, said bottom wall being excitable to a plurality of natural vibrations upon the incidence of sound at a plurality of frequencies and (2) a plurality of generally planar sidewalls which are also excitable to natural vibrations; and (b) a planar second sheet covering the upper rims of the cup-shaped indentations, wherein the air volumes contained in the individual cup-shaped indentations are at atmospheric pressure.

2. A sound-absorbing building component according to claim 1, wherein between the air volumes contained in each of the individual cup-shaped indentations and the outer atmosphere there is provided a connection so that said volumes are sealed nearly but not fully air-tight such that there is no remarkable inflow and outflow of air into and out of the air volumes during sound absorption.

3. A sound-absorbing building component according to claim 2, in which said connection is made by one or more fine openings.

4. A sound-absorbing building component according to claim 2, in which said connection is made between the cup-shaped indentations and the cover sheet.

5. A sound-absorbing building component according to claim 2, in which said connection is provided between two superimposed cup-shaped indentations.

6. A sound-absorbing building component according to claim 1, wherein the angles $\alpha$ and $\beta$ formed between the sidewalls of the cup-shaped indentations and the bottom surfaces of the cup-shaped indentations are such that $\alpha$ is in the range of from 90° to 95° and $\beta$ is in the range of from 85° to 90° and the height of said cup-shaped indentations is in the range of from 1 cm to 10 cm.

7. A sound-absorbing building component according to claim 1, wherein the first sound-absorbing sheet and the second planar sheet are formed from non-reinforced synthetic resin sheets having a thickness in the range of from 0.05 to 1 mm.

8. A sound-absorbing building component according to claim 1, wherein a connection is provided between the air volumes in each of individual cup-shaped indentations and the outer atmosphere so that the air volumes are sealed nearly but not fully air-tight such that there is no remarkable inflow and outflow of air into and out of such volumes during sound absorption, the first sound-absorbing sheet and the second planar sheet are formed from non-reinforced synthetic resin sheets having a thickness in the range of from 0.05 to 1 mm and the angles $\alpha$ and $\beta$ formed between the sidewalls of the cup-shaped indentations and the bottom surfaces of the cup-shaped indentations are such that $\alpha$ is in the range of from 90° to 95° and $\beta$ is in the range of from 85° to 90° and the height of said cup-shaped indentations is in the range of from 1 cm to 10 cm.

9. A sound-absorbing building component according to claim 1, wherein lumpy bodies are arranged in the plane of the bottom surfaces of the cup-shaped indentations.

10. A sound-absorbing building component according to claim 1, wherein the dimensional ranges of length a, width b, $b_1$ and $b_2$ of the areas $a \times b$, $a \times b_1$ and $a \times b_2$ of the bottom surfaces are such that the length a is in the range of from 1 cm to 15 cm, the widths b, $b_1$ and $b_2$ are in the range of from 1 cm to 15 cm and the areas $a \times b$, $a \times b_1$ and $a \times b_2$ are in the range of from 10 $cm^2$ to 225 $cm^2$ and the height h is in the range of from 1 cm to 10 cm.

11. A sound-absorbing building component according to claim 1, wherein webs of sheet material connect adjacent cup-shaped indentations and the material forming the bottom surfaces of the cup-shaped indentations has a uniform thickness and is thinner than the material forming the sidewalls of the cup-shaped indentations and the thickness of the material forming the sidewalls increases from adjacent the bottom surfaces to adjacent the planar sheet and said webs of sheet material have the same or a greater thickness than the sidewalls at their connections with the webs.

12. The sound-absorbing building component according to claim 1, wherein the thickness of the webs is from 1.5 to 3 times that of the material forming the bottom surfaces.

13. The sound-absorbing building component according to claim 1, wherein embossings or dimples are formed in the plane of the bottom surfaces, the diameters of said embossings or dimples being in the range of from 1 mm to 10 mm and the depths being in the range of from 1 mm to 5 mm, with the thickness of the material in which the embossings or dimples are formed being uniform over the whole bottom surface even in the areas of the embossings or dimples, the maximum depth of the embossings or dimples being not more than one-tenth of the height, of the cup-shaped indentations.

14. A sound-absorbing building component according to claim 1, wherein lumpy bodies are arranged in the plane of the bottom surfaces of the cup-shaped indentations and said lumpy bodies have a diameter in the range of from 0.5 mm to 5 mm and are statistically distributed over the whole bottom surface of the respective cup-shaped indentations.

15. A sound-absorbing building component for indoor paneling, comprising:

(a) a first sound-absorbing synthetic resin sheet 0.05 to 1 mm in thickness having a plurality of cup-shaped indentations lying side-by-side in a grid pattern, each of said cup-shaped indentations having a height of from 1 cm to 10 cm and each of said cup-shaped indentations including (1) a planar bottom wall having a surface area of 10 $cm^2$ to 225 $cm^2$ to be exposed to an acoustic field during installation, said bottom wall being excitable to a plurality of natural vibrations upon the incidence of sound at a plurality of frequencies and (2) a plurality of generally planar sidewalls which are also excitable to natural vibrations; and (b) a planar second sheet covering the upper rims of the cup-shaped indentations, wherein the air volumes contained in the individual cup-shaped indentations are at atmospheric pressure.

16. A sound-absorbing building component according to claim 15, wherein said planar second sheet is made of synthetic resin.

17. A sound-absorbing building component according to claim 15, wherein said planar bottom walls have a rectangular shape.

18. A sound-absorbing building component according to claim 15, wherein said planar bottom walls have a square shape.

19. A lightweight sound-absorbing building component for indoor paneling, comprising:

(a) a first synthetic resin sheet having a plurality of cup-shaped indentations arranged in a grid pattern, each of said cup-shaped indentations including a generally planar bottom wall having an area of between about 10 $cm^2$ and 225 $cm^2$ which are excitable to a plurality of natural vibrations upon the incidence of sound having a frequency of about 100 to about 5000 $H_z$ and a plurality of generally planar sidewalls which are also excitable to natural vibrations; and (b) a second planar synthetic resin sheet covering the upper rims of said cup-shaped indentations to form a plurality of atmospheric pressure air volumes corresponding to the individual cup-shaped indentations, wherein the bottom surfaces, the lateral surfaces and the cup-shaped indentations as a whole are excited to natural vibrations on the incidence of sound to contribute toward the absorbance of sound energy to obtain a degree of sound absorption extensively independent of the frequency in order to reduce with maximum uniformity the entire noise level in the interior rooms.

20. The sound-absorbing building component according to claim 19, wherein the bottom surface of said cup-shaped indentations have an elongated surface contour whereby a larger number of natural frequencies are attained.

21. The sound-absorbing building component according to claim 19, wherein webs of sheet material connect adjacent cup-shaped indentations and the bottom surfaces of said cup-shaped indentations are thinner than the sidewalls thereof or thinner than said webs of sheet material between the individual cup-shaped indentations.

22. The sound-absorbing building component according to claim 19, wherein said first synthetic resin sheet has a smooth uninterrupted surface.

23. The sound-absorbing building component according to claim 19, wherein said first synthetic resin sheet has a washable smooth uninterrupted surface.

24. The sound-absorbing building component according to claim 19, wherein the surface contours, the surface structures or the weights per unit area of the bottom surfaces of differing cup-shaped indentations of the same sound-absorbing building components are different or the weight per unit area of the bottom surface of a specific cup-shaped indentation is different from the weight per unit area of the remaining material of the sheet having the cup-shaped indentations, thereby broadening the frequency range of the sound absorption and increasing the degree of sound absorption of said building component.

* * * * *